US010125755B2

(12) United States Patent
Takahashi

(10) Patent No.: US 10,125,755 B2
(45) Date of Patent: Nov. 13, 2018

(54) CRYOPUMP, CONTROL METHOD OF CRYOPUMP, AND CRYOCOOLER

(71) Applicant: Sumitomo Heavy Industries, Ltd., Tokyo (JP)

(72) Inventor: Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 336 days.

(21) Appl. No.: 14/971,693

(22) Filed: Dec. 16, 2015

(65) Prior Publication Data

US 2016/0177934 A1 Jun. 23, 2016

(30) Foreign Application Priority Data

Dec. 17, 2014 (JP) ..... 2014-255028

(51) Int. Cl.
*F04B 37/08* (2006.01)

(52) U.S. Cl.
CPC ..... *F04B 37/08* (2013.01)

(58) Field of Classification Search
CPC ..... G05B 11/30; F25B 9/14
See application file for complete search history.

(56) References Cited

U.S. PATENT DOCUMENTS

2009/0282842 A1* 11/2009 Koyama ..... F04B 37/08 62/56
2011/0219810 A1 9/2011 Longsworth
2012/0031113 A1 2/2012 Tsuyuki
2013/0061609 A1* 3/2013 Fukuda ..... F04B 37/08 62/55.5
2013/0160468 A1* 6/2013 Kimura ..... F25B 49/022 62/6
2013/0232999 A1* 9/2013 Matsui ..... B01D 8/00 62/55.5

FOREIGN PATENT DOCUMENTS

JP 2013-522576 A 6/2013
WO WO-2005/052369 A1 6/2005

* cited by examiner

*Primary Examiner* — Brian King
(74) *Attorney, Agent, or Firm* — Michael Best & Friedrich LLP

(57) ABSTRACT

A cryopump includes a cryopanel, a cryocooler which is configured to cool the cryopanel, and includes a cryocooler motor configured to drive the cryocooler and a cryocooler inverter configured to control an operating frequency of the cryocooler motor, and a control unit configured to control the cryocooler to perform a cool-down operation by which a temperature of the cryopanel is decreased from room temperature to a standard operating temperature. The control unit includes an operating frequency determination unit configured to determine an operating frequency of the cryocooler motor within an operating frequency range having an upper limit operating frequency and outputs the operating frequency to the cryocooler inverter, and an upper limit adjustment unit configured to decrease the upper limit operating frequency based on a decrease in a temperature of the cryopanel during the cool-down operation.

8 Claims, 6 Drawing Sheets

CRYOPUMP, CONTROL METHOD OF CRYOPUMP, AND CRYOCOOLER

RELATED APPLICATIONS

Priority is claimed to Japanese Patent Application No. 2014-255028, filed Dec. 17, 2014, the entire content of which is incorporated herein by reference.

BACKGROUND

Technical Field

Certain embodiments of the invention relate to a cryopump, a control method of a cryopump, and a cryocooler.

Description of Related Art

When a new cryopump is installed at a site, the cryopump is cooled from room temperature to a cryogenic temperature, and a vacuum exhaust operation starts.

In addition, as is known, since the cryopump is a gas storage type vacuum pump, regeneration is performed on the cryopump at a certain frequency in order to discharge the stored gas to the outside. In general, regeneration processing includes a temperature raising stage, a discharging stage, and a cooling stage. When the cooling stage ends, the vacuum exhaust operation of the cryopump is restarted. The cooling of the cryopump for preparing the vacuum exhaust operation may be referred to as a cool-down operation.

SUMMARY

According to an embodiment of the present invention, there is provided a cryopump, including a cryopanel; a cryocooler which is configured to cool the cryopanel, and includes a cryocooler motor configured to drive the cryocooler and a cryocooler inverter configured to control an operating frequency of the cryocooler motor; and a control unit configured to control the cryocooler to perform a cool-down operation by which a temperature of the cryopanel is decreased from room temperature to a standard operating temperature. The control unit includes an operating frequency determination unit configured to determine an operating frequency of the cryocooler motor within an operating frequency range having an upper limit operating frequency and outputs the operating frequency to the cryocooler inverter, and an upper limit adjustment unit configured to decrease the upper limit operating frequency based on a decrease in a temperature of the cryopanel during the cool-down operation.

According to another embodiment of the present invention, there is provided a control method of a cryopump. The cryopump includes a cryopanel, and a cryocooler which is configured to cool the cryopanel, and includes a cryocooler motor configured to drive the cryocooler and a cryocooler inverter configured to control an operating frequency of the cryocooler motor. The method includes performing a cool-down operation by which a temperature of the cryopanel is decreased from room temperature to a standard operating temperature, decreasing an upper limit operating frequency of the cryocooler motor based on a decrease in a temperature of the cryopanel during the cool-down operation, determining an operating frequency of the cryocooler motor within an operating frequency range having the upper limit operating frequency, and outputting the determined operating frequency to the cryocooler inverter.

According to still another embodiment of the present invention, there is provided a cryocooler, including: an expander which includes a cooling stage, an expander motor configured to drive the expander, and an expander inverter configured to control an operating frequency of the expander motor; and a control unit configured to control the expander to perform a cool-down operation by which a temperature of the cooling stage is decreased from room temperature to a standard operating temperature. The control unit includes an operating frequency determination unit configured to determine an operating frequency of the expander motor within an operating frequency range having an upper limit operating frequency and outputs the operating frequency to the expander inverter, and an upper limit adjustment unit configured to decrease the upper limit operating frequency based on a decrease in a temperature of the cooling stage during the cool-down operation.

In addition, aspects of the present invention includes arbitrary combinations of the above-described components, or components or representations of the present invention which are replaced by each other among a device, a method, a system, a computer program, a recording medium storing a computer program, or the like.

DETAILED DESCRIPTION

Figure 1:
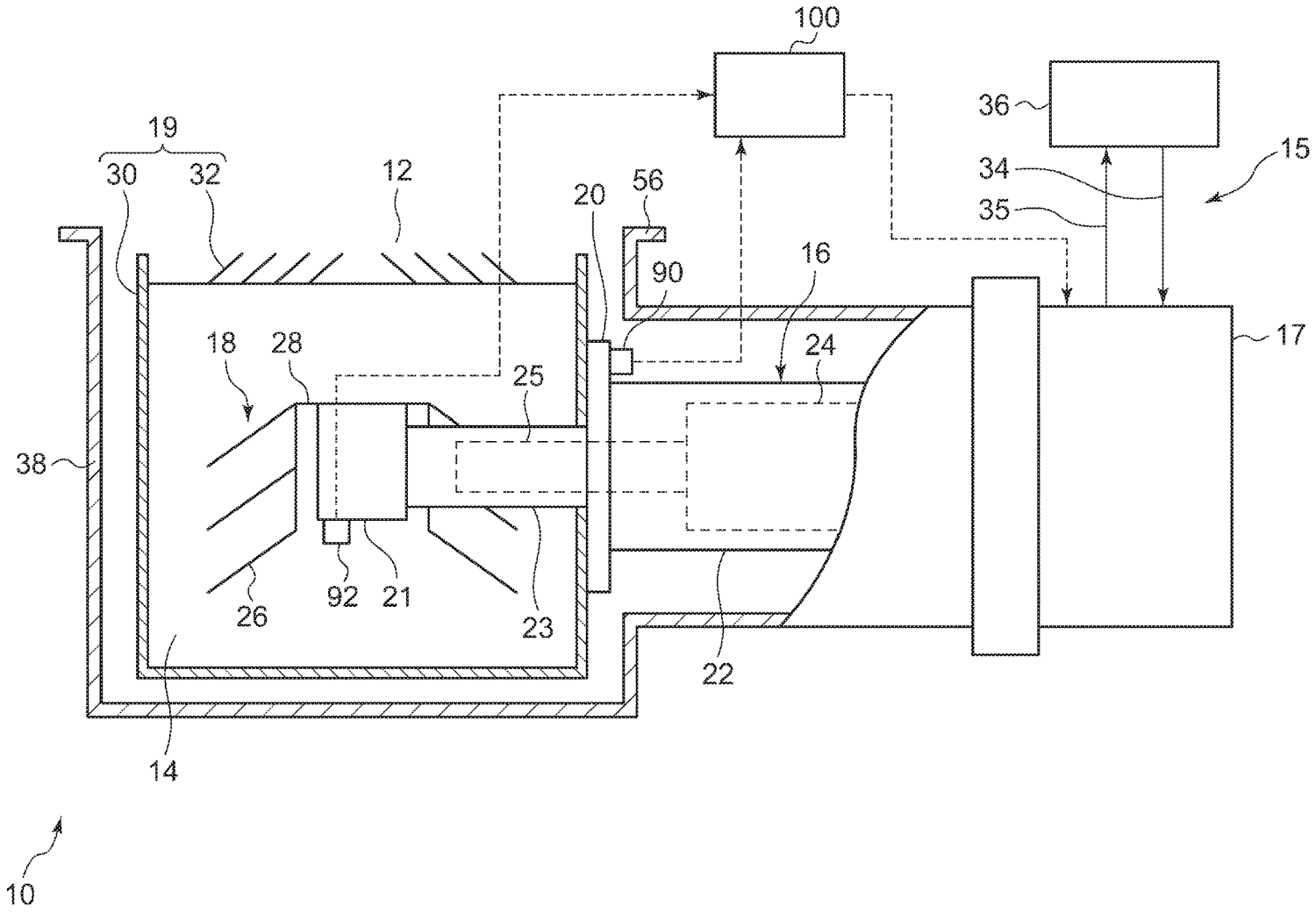
FIG. 1 is a diagram schematically showing an embodiment of the present invention.

A cryopump is one of main applications of a cryocooler. However, this application is different from other applications since a relatively high temperature difference is required between a high temperature stage and a low temperature stage of the cryocooler. However, when the cryopump is cooled, it is not easy to generate the temperature difference in a short period of time. For example, if the low temperature stage has not yet reached a target temperature when the high temperature stage reaches a target cooling temperature, the low temperature stage should be further cooled while the high temperature is maintained at the target temperature. In addition, when the low temperature stage reaches the target temperature, the high temperature stage may be excessively cooled to reach a lower temperature than the target temperature. In this case, the temperature of the high temperature stage should be increased so as to reach the target temperature. In order to adjust the temperature at the end of the cool-down operation, a certain period of time is required. Particularly, when a great temperature difference is required between the high temperature stage and the low temperature stage, the time required for adjusting the temperature increases. Since the cool-down operation becomes a downtime of the cryopump, it is preferable to perform the cool-down operation in a short period of time.

It is desirable to shorten a cooling time of the cryopump.

According to the present invention, it is possible to shorten a cooling time of a cryopump.

Hereinafter, embodiments of the present invention will be described in detail with reference to the drawings. In addition, in the descriptions, the same reference numerals are assigned to the same elements, and descriptions thereof are appropriately omitted. In addition, the configurations described below are only examples, and the scope of the invention is not limited thereto.

FIG. 1 is a diagram schematically showing a cryopump 10 according to an embodiment of the present invention. For example, the cryopump 10 is attached to a vacuum chamber such as an ion implanter or a sputtering apparatus, and is used for increasing the vacuum degree inside the vacuum chamber to a level required by a desired process.

The cryopump 10 includes an intake port 12 for receiving gas. The intake port 12 is an inlet to an inner space 14 of the cryopump 10. Gas, which is to be discharged through the intake port 12 from the vacuum chamber to which the cryopump 10 is attached, enters the inner space 14 of the cryopump 10.

In addition, hereinafter, for easy understanding of a positional relationship between components of the cryopump 10, a term such as an "axial direction" or a "radial direction" may be used. The axial direction indicates a direction in which gas passes through the intake port 12, and the radial direction indicates a direction along the intake port 12. For convenience, a side which is relatively close to the intake port 12 in the axial direction is referred to as an "upper side", and a side which is far from the intake port 12 in the axial direction is referred to as a "lower side". That is, a side which is relatively far from the bottom portion of the cryopump 10 is referred to as an "upper side", and a side which is relatively close to the bottom portion of the cryopump 10 is referred to as a "lower side". In the radial direction, a side which is relatively close to the center of the intake port 12 is referred to as an "inner side", and a side which is relatively close to a circumferential edge of the intake port 12 is referred to as an "outer side". In addition, the expressions are not relevant to disposition when the cryopump 10 is attached to the vacuum chamber. For example, the cryopump 10 may be attached to the vacuum chamber in a vertical direction in a state where the intake port 12 faces downward.

The cryopump 10 includes a cooling system 15, a low temperature cryopanel 18, and a high temperature cryopanel 19. The cooling system 15 is configured so as to cool the high temperature cryopanel 19 and the low temperature cryopanel 18. The cooling system 15 includes a cryocooler 16 and a compressor 36.

For example, the cryocooler 16 is a cryocooler such as a Gifford McMahon type cryocooler (a so-called GM cryocooler). The cryocooler 16 is a two-stage type cryocooler which includes a first stage 20, a second stage 21, a first cylinder 22, a second cylinder 23, a first displacer 24, and a second displacer 25. Accordingly, a high temperature stage of the cryocooler 16 includes the first stage 20, the first cylinder 22, and the first displacer 24. A low temperature stage of the cryocooler 16 includes the second stage 21, the second cylinder 23, and the second displacer 25. Accordingly, hereinafter, the first stage 20 and the second stage 21 may be referred to as a low temperature end of the high temperature stage and a low temperature end of the low temperature stage, respectively.

The first cylinder 22 and the second cylinder 23 are connected to each other in series. The first stage 20 is installed in a connection portion between the first cylinder 22 and the second cylinder 23. The second cylinder 23 is connected to the first stage 20 and the second stage 21. The second stage 21 is installed in the end of the second cylinder 23. Each of the first displacer 24 and the second displacer 25 is movably disposed inside each of the first cylinder 22 and the second cylinder 23 in a longitudinal direction (a right-left direction in FIG. 1) of the cryocooler 16. The first displacer 24 and the second displacer 25 are connected to each other so as to be integrally moved. A first regenerator (not shown) and a second regenerator (not shown) are incorporated into the first displacer 24 and the second displacer 25, respectively.

The cryocooler 16 includes a drive mechanism 17 which is provided on a high temperature end of the first cylinder 22. The drive mechanism 17 is connected to the first displacer 24 and the second displacer 25 so that each of the first displacer 24 and the second displacer 25 can reciprocate inside each of the first cylinder 22 and the second cylinder 23. In addition, the drive mechanism 17 includes a flow path switching mechanism which switches a flow path of an operating gas so as to periodically repeat intake and discharge of the operating gas. For example, the flow path switching mechanism includes a valve portion and a drive portion which drives the valve portion. For example, the valve portion includes a rotary valve, and the drive portion includes a motor which rotates the rotary valve. The motor may be an AC motor or a DC motor. In addition, the flow path switching mechanism may be a direct acting type mechanism which is driven by a linear motor.

The cryocooler 16 is connected to a compressor 36 via a high pressure conduit 34 and a low pressure conduit 35. The cryocooler 16 expands a high pressure operating gas (for example, helium) supplied from the compressor 36 to inside the cryocooler 16, and generates coldness in the first stage 20 and the second stage 21. The compressor 36 receives the operating gas expanded by the cryocooler 16, pressurizes the operating gas again, and supplies the operating gas to the cryocooler 16.

Specifically, first, the drive mechanism 17 causes the high pressure conduit 34 and an inner space of the cryocooler 16 to communicate with each other. A high pressure operating gas is supplied from the compressor 36 to the cryocooler 16 through the high pressure conduit 34. When the inner space of the cryocooler 16 is filled with the high pressure operating gas, the drive mechanism 17 switches the flow path so that the inner space of the cryocooler 16 communicates with the low pressure conduit 35. Accordingly, the operating gas is expanded. The expanded operating gas is recovered by the compressor 36. Each of the first displacer 24 and the second displacer 25 reciprocates inside each of the first cylinder 22 and the second cylinder 23 in synchronization with the supply and the discharge of the operating gas. By repeating this thermal cycle, the cryocooler 16 generates coldness in the first stage 20 and the second stage 21.

The cryocooler 16 is configured to cool the first stage 20 such that it reaches a first temperature level, and cool the second stage 21 such that it reaches a second temperature level. The second temperature level is lower than the first temperature level. For example, the first stage 20 is cooled to approximately 65 K to 120 K, preferably, 80 K to 100 K, and the second stage 21 is cooled to approximately 10 K to 20 K.

The cryocooler 16 is configured so that the operating gas flows to the low temperature stage through the high temperature stage. That is, the operating gas flowing inside from the compressor 36 flows from the first cylinder 22 to the second cylinder 23. In this case, the operating gas is cooled so as to reach the temperature of the first stage 20 (that is, the low temperature end of the high temperature stage) by the first displacer 24 and the regenerator. The cooled operating gas is supplied to the low temperature stage. Accordingly, it is expected that the temperature of the operating gas introduced into the high temperature stage of the cryocooler 16 from the compressor 36 does not significantly influence the cooling capacity of the low temperature stage.

In addition, the cryocooler 16 may be a three-stage cryocooler in which three cylinders are connected to each other in series, or may be a multi-stage cryocooler in which four or more cylinders are connected to each other. The cryocooler 16 may be a cryocooler other than a GM cryocooler, and may use a pulse tube cryocooler or a Solvay cryocooler.

FIG. 1 shows a section including a center axis of the inner space 14 of the cryopump 10 and a center axis of the cryocooler 16. The cryopump 10 shown in FIG. 1 is a so-called horizontal type cryopump. In general, the horizontal type cryopump is a cryopump in which the cryocooler 16 crosses (typically, is orthogonal to) the center axis of the inner space 14 of the cryopump 10. The invention may be similarly applied to a so-called vertical type cryopump. The vertical type cryopump is a cryopump in which the cryocooler is disposed along an axial direction of the cryopump.

The low temperature cryopanel 18 is provided in the center portion of the inner space 14 of the cryopump 10. For example, the low temperature cryopanel 18 includes a plurality of panel members 26. For example, each of the panel members 26 has a truncated cone-shaped side surface, that is, an umbrella shape. In general, an adsorbent (not shown) such as activated carbon is provided in each panel member 26. For example, the adsorbent is attached to a rear surface of the panel member 26. Accordingly, the low temperature cryopanel 18 includes an adsorption region for adsorbing gas molecules.

The panel member 26 is attached to a panel attachment member 28. The panel attachment member 28 is attached to the second stage 21. Accordingly, the low temperature cryopanel 18 is thermally connected to the second stage 21. Therefore, the low temperature cryopanel 18 is cooled so as to reach the second temperature level.

The high temperature cryopanel 19 includes a radiation shield 30 and an inlet cryopanel 32. The high temperature cryopanel 19 is provided outside the low temperature cryopanel 18 so as to enclose the low temperature cryopanel 18. The high temperature cryopanel 19 is thermally connected to the first stage 20, and the high temperature cryopanel 19 is cooled so as to reach the first temperature level.

The radiation shield 30 is mainly provided so as to protect the low temperature cryopanel 18 from a radiant heat generated from a housing 38 of the cryopump 10. The radiation shield 30 encloses the low temperature cryopanel 18 between the housing 38 and the low temperature cryopanel 18. An upper end in the axial direction of the radiation shield 30 opens toward the intake port 12. The radiation shield 30 has a tubular (for example, cylindrical) shape in which a lower end in the axial direction is closed, and is formed in a cup shape. A hole for attaching the cryocooler 16 is provided on the side surface of the radiation shield 30, and the second stage 21 is inserted into the radiation shield 30 from the hole. The first stage 20 is fixed to the outer surface of the radiation shield 30 in the outer circumferential portion of the attachment hole. In this way, the radiation shield 30 is thermally connected to the first stage 20.

The inlet cryopanel 32 is provided on the upper side in the axial direction of the low temperature cryopanel 18, and is disposed along the radial direction in the intake port 12. The outer circumferential portion of the inlet cryopanel 32 is fixed to the opening end of the radiation shield 30, and the inlet cryopanel 32 is thermally connected to the radiation shield 30. For example, the inlet cryopanel 32 is formed in a louver structure or a chevron structure. The inlet cryopanels 32 may be concentrically formed with the center axis of the radiation shield 30 as the center, or may be formed in other shapes such as a lattice shape.

The inlet cryopanel 32 is provided so as to discharge the gas entering the intake port 12. The gas (for example, water) which condenses at the temperature of the inlet cryopanel 32 is trapped on the surface of the inlet cryopanel 32. In addition, the inlet cryopanel 32 is provided so as to protect the low temperature cryopanel 18 from a radiant heat from a heat source (for example, a heat source in the vacuum chamber into which the cryopump 10 is attached) outside the cryopump 10. The inlet cryopanel 32 limits not only entrance of the radiant heat but also entrance of gas molecules. The inlet cryopanel 32 occupies a portion of the area of the opening of the intake port 12 to limit a gas flowing into the inner space 14 through the intake port 12 so as to reach a desired amount.

The cryopump 10 includes the housing 38. The housing 38 is a vacuum vessel for separating the inner portion and the outside of the cryopump 10 from each other. The housing 38 is configured so as to airtightly maintain the pressure of the inner space 14 of the cryopump 10. The high temperature cryopanel 19 and the cryocooler 16 are accommodated in the housing 38. The housing 38 is provide outside the high temperature cryopanel 19, and encloses the high temperature cryopanel 19. In addition, the housing 38 accommodates the cryocooler 16. That is, the housing 38 is a vessel of the cryopump which encloses the high temperature cryopanel 19 and the low temperature cryopanel 18.

The housing 38 is fixed to a portion (for example, a high temperature portion of the cryocooler 16) of an external environment temperature so as to be in non-contact with the high temperature cryopanel 19 and the low temperature portion of the cryocooler 16. The outer surface of the housing 38 is exposed to the external environment, and the temperature of the housing 38 is higher than the temperature of the cooled high temperature cryopanel 19 (for example, the temperature of the housing 38 is approximately room temperature).

In addition, the housing 38 includes an intake port flange 56 which extends toward the outside in the radial direction from the opening end of the housing 38. The intake port flange 56 is a flange for attaching the cryopump 10 to the attachment vacuum chamber. A gate valve (not shown) is provided in the opening of the vacuum chamber, and the intake port flange 56 is attached to the gate valve. In this way, the gate valve is positioned on the upper side in the axial direction of the inlet cryopanel 32. For example, when the cryopump 10 is regenerated, the gate valve is closed, and the gate valve is open when the gas in the vacuum chamber is discharged by the cryopump 10.

The cryopump 10 includes a first temperature sensor 90 for measuring the temperature of the first stage 20, and a second temperature sensor 92 for measuring the temperature of the second stage 21. The first temperature sensor 90 is attached to the first stage 20. The second temperature sensor 92 is attached to the second stage 21. In addition, the first temperature sensor 90 may be attached to the high temperature cryopanel 19. The second temperature sensor 92 may be attached to the low temperature cryopanel 18.

In addition, the cryopump 10 includes a control unit 100. The control unit 100 may be provided integrally with the cryopump 10, or may be configured of a controller separated from the cryopump 10.

The control unit 100 is configured so as to control the cryocooler 16 to perform a vacuum exhaust operation, a regeneration operation, and a cool-down operation of the cryopump 10. The control unit 100 is configured so as to receive measurement results of various sensors including the first temperature sensor 90 and the second temperature sensor 92. The control unit 100 calculates a control command applied to the cryocooler 16, based on the measurement results.

The control unit 100 controls the cryocooler 16 so that the temperature of the stage follows a target cooling temperature. In general, the target temperature of the first stage 20 is set to a constant value. For example, the target temperature of the first stage 20 is determined by specifications corresponding to a process which is performed by a vacuum chamber to which the cryopump 10 is attached. In addition, during the operation of the cryopump, the target temperature may be changed if necessary.

For example, the control unit 100 controls an operating frequency of the cryocooler 16 using a feedback control to minimize a deviation between the target temperature of the first stage 20 and the measurement temperature of the first temperature sensor 90. That is, the control unit 100 controls a motor rotating speed of the drive mechanism 17, and controls a frequency of a thermal cycle in the cryocooler 16.

The temperature of the first stage 20 increases when a thermal load to the cryopump 10 increases. When the measurement temperature of the first temperature sensor 90 is higher than the target temperature, the control unit 100 increases the operating frequency of the cryocooler 16. As a result, the frequency of the thermal cycle in the cryocooler 16 also increases, and the first stage 20 is cooled so as to reach the target temperature. Conversely, when the measurement temperature of the first temperature sensor 90 is lower than the target temperature, the operating frequency of the cryocooler 16 decreases, and the temperature of the first stage 20 increases so as to reach the target temperature. Accordingly, it is possible to hold the temperature of the first stage 20 within a temperature range in the vicinity of the target temperature. Since it is possible to appropriately adjust the operating frequency of the cryocooler 16 according to the thermal load, the control contributes to reduction of power consumption of the cryopump 10.

Hereinafter, controlling the cryocooler 16 so that the temperature of the first stage 20 is set to the target temperature is referred to as a "first stage temperature control". In general, when the cryopump 10 performs the vacuum exhaust operation, the first stage temperature control is performed. As a result of the first stage temperature control, the second stage 21 and the low temperature cryopanel 18 are cooled so as to reach the temperature determined by the specifications of the cryocooler 16 and the thermal load from the outside. Similarly, the control unit 100 may perform a "second stage temperature control" which controls the cryocooler 16 so that the temperature of the second stage 21 is set to the target temperature.

Figure 2:
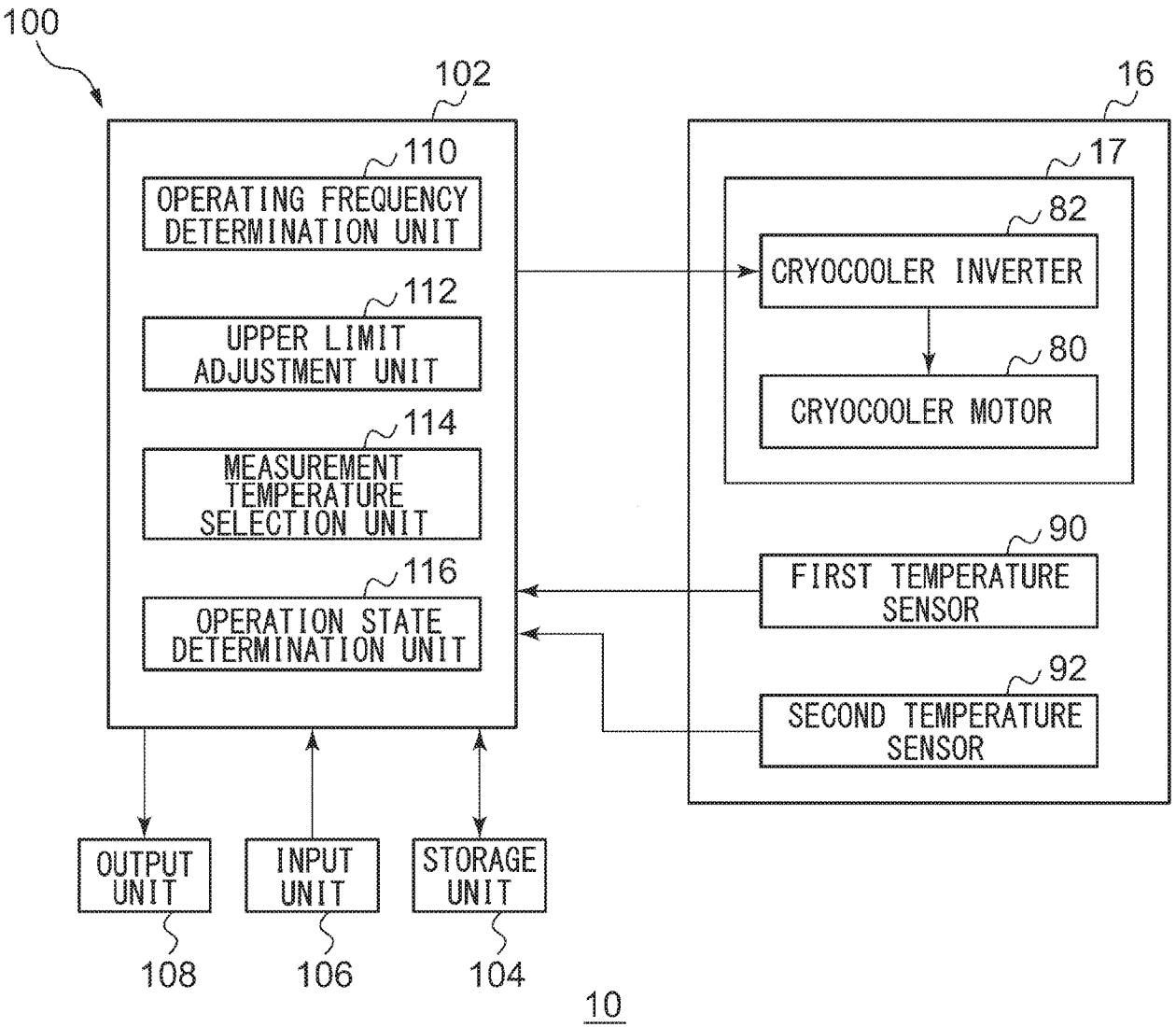
FIG. 2 is a diagram which schematically shows a configuration of a control unit of a cryopump according to the embodiment of the present invention.

FIG. 2 is a diagram which schematically shows the configuration of the control unit 100 of the cryopump 10 according to the embodiment of the present invention. The controller is realized by hardware, software, and combination thereof. In addition, in FIG. 2, a configuration of a portion of the related cryocooler 16 is schematically shown.

The drive mechanism 17 of the cryocooler 16 includes a cryocooler motor 80 which drives the cryocooler 16, and a cryocooler inverter 82 which controls the operating frequency of the cryocooler 16. As described above, the cryocooler 16 is an expander of the operation gas. Accordingly, the cryocooler motor 80 and the cryocooler inverter 82 may be referred to as an expander motor and an expander inverter, respectively.

The operating frequency (referred to as an operation speed) of the cryocooler 16 indicates the operating frequency or the rotating speed of the cryocooler motor 80, the operating frequency of the cryocooler inverter 82, the frequency of the thermal cycle, or any one thereof. The frequency of the thermal cycle is the number of times per unit time of the thermal cycle performed in the cryocooler 16.

The control unit 100 includes a cryocooler control unit 102, a storage unit 104, an input unit 106, and an output unit 108. The cryocooler control unit 102 is configured to control the cryocooler 16 so as to perform the vacuum exhaust operation and the regeneration operation of the cryopump 10. The cryocooler control unit 102 is configured to control the cryocooler 16 so as to perform the cool-down operation to decrease the temperature of at least one cryopanel (low temperature cryopanel 18 and/or high temperature cryopanel 19, hereinafter, similarly applied) from room temperature to a standard operating temperature. The cryocooler control unit 102 is configured to control the cryocooler 16 so as to perform a temperature control operation, which maintains the temperature of at least one cryopanel to the standard operating temperature, following the cool-down operation.

The storage unit 104 is configured to store information related to the control of the cryopump 10. The input unit 106 is configured to receive input from a user or other devices. For example, the input unit 106 includes an input section such as a mouse or a keyboard for receiving the input from the user, and/or a communication section for communicating with other devices. The output unit 108 is configured to output the information related to the control of the cryopump 10, and includes an output section such as a display or a printer. Each of the storage unit 104, the input unit 106, and the output unit 108 is connected so as to communicate with the cryocooler control unit 102.

The cryocooler control unit 102 includes an operating frequency determination unit 110, an upper limit adjustment unit 112, a measurement temperature selection unit 114, and an operation state determination unit 116. As described above, the operating frequency determination unit 110 is configured to determine the operating frequency of the cryocooler motor 80 which is a function of the deviation between the measurement temperature of the cryopanel and the target temperature (using a PID control, for example). The operating frequency determination unit 110 determines the operating frequency of the cryocooler motor 80 within a predetermined operating frequency range. The operating frequency range is determined by the upper limit and the lower limit of the predetermined operating frequency. The operating frequency determination unit 110 outputs the determined operating frequency to the cryocooler inverter 82.

The cryocooler inverter 82 is configured to supply a variable frequency control of the cryocooler motor 80. The cryocooler inverter 82 converts input power so as to have the operating frequency input from the operating frequency determination unit 110. The input power to the cryocooler inverter 82 is supplied from a cryocooler power source (not shown). The cryocooler inverter 82 outputs the converted power to the cryocooler motor 80. Accordingly, the cryocooler motor 80 is driven by the operating frequency which is determined by the operating frequency determination unit 110 and is output from the cryocooler inverter 82.

The upper limit adjustment unit 112 is configured so as to adjust the upper limit operating frequency based on the temperature of the cryopanel during the cool-down operation. For example, the upper limit adjustment unit 112 is configured so as to decrease the upper limit operating frequency based on a decrease in the temperature of the cryopanel during the cool-down operation.

The measurement temperature selection unit 114 is configured so as to select the lower temperature of the temperature of the high temperature cryopanel 19 measured by the first temperature sensor 90 and the temperature of the low temperature cryopanel 18 measured by the second temperature sensor 92. The upper limit adjustment unit 112 adjusts the upper limit operating frequency using the measurement temperature selected by the measurement temperature selection unit 114.

The operation state determination unit 116 is configured so as to determine the operation state of the cryopump 10. An operation state flag corresponding to each of a plurality of operation states different from each other may be predetermined. The storage unit 104 may store the operation state flags. The operation state determination unit 116 may be configured so as to select the operation stage flag corresponding to the operation state when the cryopump 10 is brought into a certain operation state. The operation state determination unit 116 may determine a current operation state of the cryopump 10 with reference to the selected operation state flag. The operation state determination unit 116 may include a cool-down determination unit which determines whether or not the cool-down operation is performed.

The storage unit 104 stores an upper limit frequency profile which is input from the input unit 106. The upper limit frequency profile is predetermined experimentally or empirically. The upper limit adjustment unit 112 changes the upper limit operating frequency according to the upper limit frequency profile.

The upper limit frequency profile includes a first upper limit frequency with respect to a first temperature region, and a second upper limit frequency with respect to a second temperature region. The first upper limit frequency is a maximum value within a first frequency range with respect to the first temperature region, and the second upper limit frequency is a maximum value within a second frequency range with respect to the second temperature region. The second upper limit frequency is smaller than the first upper limit frequency. In addition, the second upper limit frequency is a greater value than a normal operating frequency in the temperature control operation (for example, the above-described first stage temperature control) following the cool-down operation. Accordingly, for example, a decreased amount from the first upper limit frequency to the second upper limit frequency may be within 25% of the first upper limit frequency.

The upper limit frequency profile may include a first lower limit frequency with respect to the first temperature region, and a second lower limit frequency with respect to the second temperature region. Each of the first lower limit frequency and the second lower limit frequency is the minimum value of each of the first frequency range and the second frequency range. The first lower limit frequency and the second lower limit frequency may be a common value. The lower limit frequency and the upper limit frequency may be the same as each other. In this case, the frequency range has a single value.

The first temperature region includes room temperature. The second temperature region is a temperature range which is lower than the first temperature region including the standard operating temperature, and is adjacent to the first temperature region. A boundary temperature between the first temperature region and the second temperature region is an intermediate temperature between room temperature and the standard operating temperature. For example, the boundary temperature may be less than or equal to 200 K. In addition, for example, the boundary temperature may be a temperature more than 130 K.

The upper limit frequency profile may include a third upper limit frequency with respect to a third temperature region. The third temperature region may be an intermediate temperature region between the first temperature region and the second temperature region. The third upper limit frequency is an intermediate value between the first upper limit frequency and the second upper limit frequency. In addition, the upper limit frequency profile may include a plurality of upper limit frequencies corresponding to a plurality of temperature points which are different from each other between room temperature and the standard operating temperature. In this case, the upper limit frequency profile may be determined so that the upper limit frequency gradually decreases as the temperature decreases.

Figure 3:
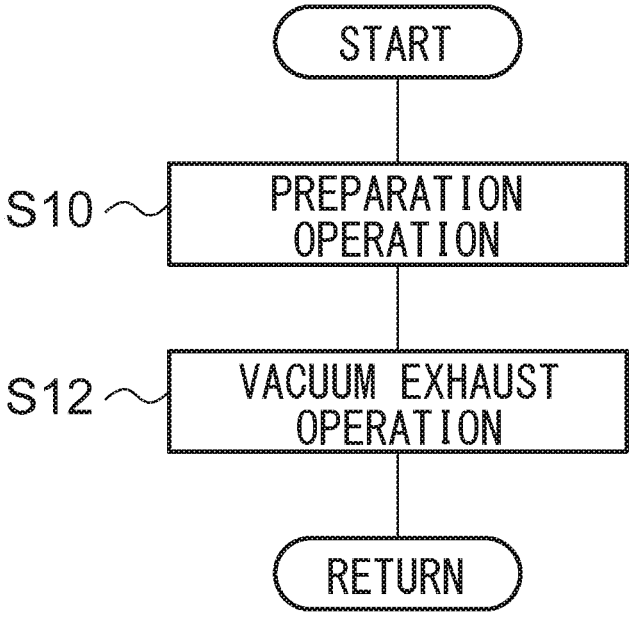
FIG. 3 is a flowchart for explaining an operation method of the cryopump.

FIG. 3 is a flowchart for explaining an operation method of the cryopump 10. The operation method includes a preparation operation (S10) and a vacuum exhaust operation (S12). The vacuum exhaust operation is a normal operation of the cryopump 10. The preparation operation includes an arbitrary operation state which is performed preceding the normal operation. The control unit 100 appropriately and repeatedly performs the operation method. When the vacuum exhaust operation ends and the preparation operation starts, in general, a gate valve between the cryopump 10 and the vacuum chamber is closed.

For example, the preparation operation (S10) is actuation of the cryopump 10. The actuation of the cryopump 10 includes a cool-down operation which cools the cryopanel from a temperature (for example, room temperature) of an installation environment of the cryopump 10 to a cryogenic temperature. A target cooling temperature of the cool-down operation is the standard operating temperature which is set to perform the vacuum exhaust operation. As described above, the standard operating temperature is selected from a range between approximately 80 K and 100 K with respect to the high temperature cryopanel 19, for example, and is selected from a range between approximately 10 K and 20 K with respect to the low temperature cryopanel 18, for example. The preparation operation (S10) may include roughly evacuating the pressure of the inner portion of the cryopump 10 so as to reach an operation start pressure (for example, approximately 1 Pa) using a rough evacuation valve (not shown) or the like.

The preparation operation (S10) may be regeneration of the cryopump 10. The regeneration is performed so as to prepare a next vacuum exhaust operation after a current vacuum exhaust operation ends. The regeneration is so-called full regeneration which regenerates the low temperature cryopanel 18 and the high temperature cryopanel 19, or partial regeneration which regenerates only the low temperature cryopanel 18.

The regeneration includes a temperature raising step, a discharging step, and a cooling step. The temperature raising step includes increasing the temperature of the cryopump 10 so as to reach a regeneration temperature which is higher than the standard operating temperature. In the case of the full regeneration, for example, the regeneration temperature may be room temperature, or a temperature (for example, approximately 290 K to approximately 300 K) which is slightly higher than room temperature. For example, a heat source for performing the temperature raising step is a reverse temperature-increase of the cryocooler 16 and/or a heater attached to the cryocooler 16.

The discharging step includes discharging the gas re-vaporized from the surface of the cryopanel to the outside of the cryopump 10. The re-vaporized gas is discharged from the cryopump 10 along with purge gas which is introduced if necessary. In the discharging step, the operation of the cryocooler 16 is stopped. The cooling step includes re-cooling the low temperature cryopanel 18 and the high temperature cryopanel 19 for restarting the vacuum exhaust operation. The operation state of the cryocooler 16 in the cooling step is similar to the cool-down operation for starting the cryocooler 16. However, an initial temperature of the cryopanel in the cooling step is at a room temperature level in a case of a full regeneration. However, the initial temperature is an intermediate temperature (for example, 100 K to 200 K) between room temperature and the standard operating temperature in a case of a partial regeneration.

As shown in FIG. 3, the vacuum exhaust operation (S12) is performed following the preparation operation (S10). When the preparation operation ends and the vacuum exhaust operation starts, the gate valve is open between the cryopump 10 and the vacuum chamber.

In the vacuum exhaust operation (S12), an operation state is performed, in which gas molecules coming flying from the vacuum chamber toward the cryopump 10 are trapped on the surface of the cryopanel cooled so as to reach a cryogenic temperature by condensation and absorption. In the high temperature cryopanel 19 (for example, inlet cryopanel 32), gas (for example, water or the like) in which a vapor pressure sufficiently decreases at the cooling temperature is condensed. Gas, in which the vapor pressure does not sufficiently decrease at the cooling temperature of the inlet cryopanel 32, passes through the inlet cryopanel 32 and enters the radiation shield 30. In the low temperature cryopanel 18, gas (for example, argon or the like) in which the vapor pressure sufficiently decreases at the cooling temperature is condensed. Gas (for example, hydrogen or the like) in which the vapor pressure does not sufficiently decrease in the cooling temperature of the low temperature cryopanel 18 is adsorbed to an adsorbent of the low temperature cryopanel 18. Accordingly, the cryopump 10 can cause the vacuum degree of the vacuum chamber to reach a desired level.

The vacuum exhaust operation is a normal operation state in which the standard operating temperature is maintained. Meanwhile, since a period of the preparation operation corresponds to a downtime (that is, a pause period of the vacuum exhaust operation) of the cryopump 10, it is preferable to shorten the period of the preparation operation as much as possible. Accordingly, in the preparation operation, a cooling capacity which is higher than that of the normal operation is required in the cryocooler 16. In most cases, in the preparation operation, the cryocooler 16 is operated at a very high operating frequency (for example, at an allowable maximum operating frequency or near the maximum operating frequency).

Figure 4:
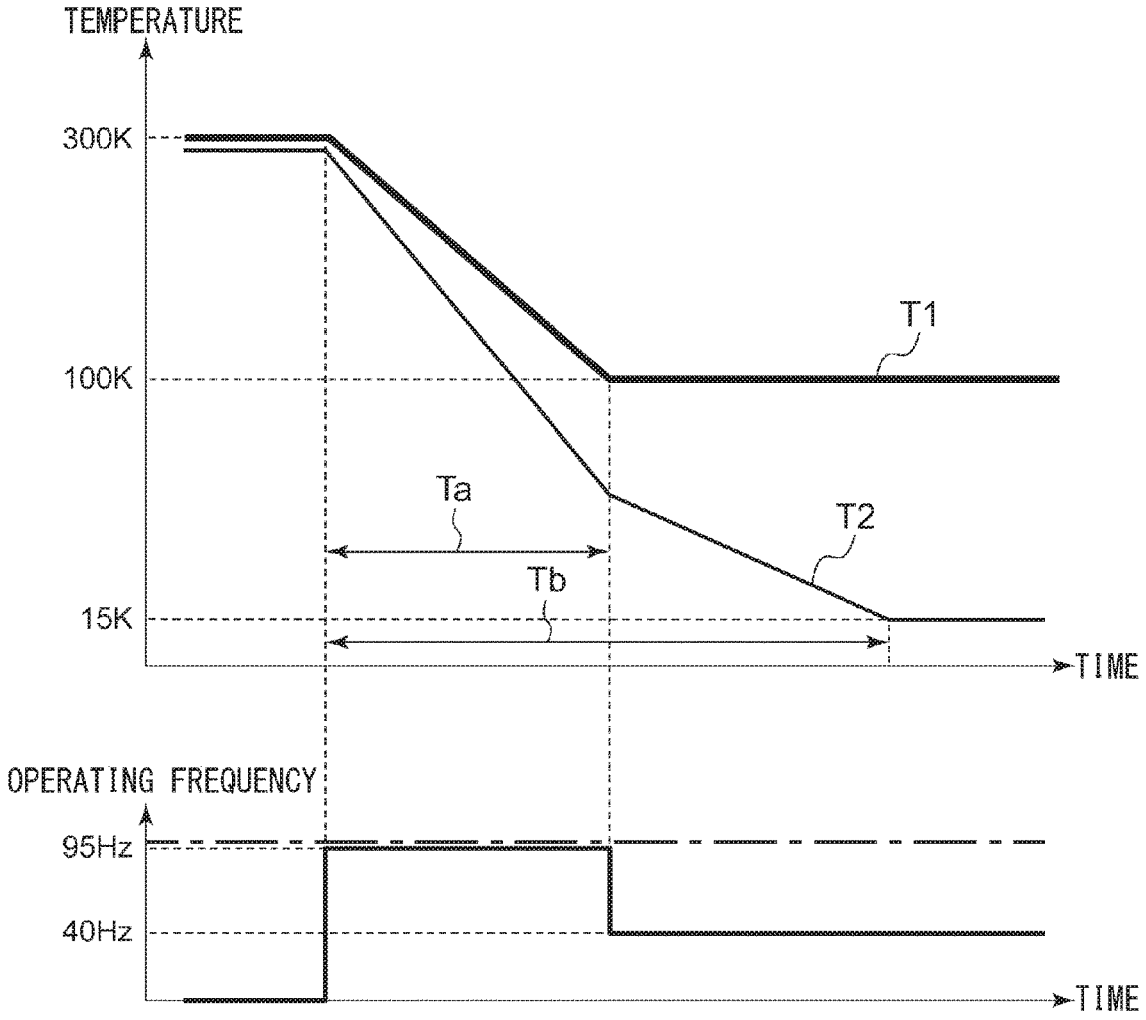
FIG. 4 is a diagram showing an example of a temperature profile in a typical cool-down operation.

FIG. 4 is a diagram showing an example of a temperature profile in a typical cool-down operation. In FIG. 4, a vertical axis indicates a temperature, and a horizontal axis indicates a time. In FIG. 4, temporal changes of a temperature T1 of the first stage 20 and a temperature T2 of the second stage 21 are schematically shown. For example, the initial values of the temperature T1 of the first stage 20 and the temperature T2 of the second stage 21 when the cool-down operation starts are 300 K, and the target cooling temperatures of the first stage 20 and the second stage 21 are 100 K and 15 K, respectively. In addition, in the lower portion of FIG. 4, an example of an operating frequency profile of the cryocooler 16 is shown.

In a typical cryopump control, the range of the operating frequency of the cryocooler 16 is not changed during the operation. Accordingly, as shown by a dashed line in the lower portion of FIG. 4, the upper limit of the operating frequency of the cryocooler 16 is constant.

In the cool-down operation shown in FIG. 4, the cryocooler 16 is operated with full power until the temperature T1 of the first stage 20 reaches the target temperature 100 K. In this case, the operating frequency of the cryocooler 16 is fixed at the allowable maximum value (for example, 95 Hz operating frequency). Accordingly, the first stage 20 is rapidly cooled to the target temperature 100 K. When a time Ta elapses from starting of the cool-down operation, the temperature T1 of the first stage 20 reaches the target temperature 100 K. In this case, the cryocooler 16 is switched from the full power operation to the above-described first stage temperature control. Thereafter, the temperature T1 of the first stage 20 is maintained at the target temperature 100 K. The cryocooler 16 is switched from the full power operation to the first stage temperature control. Accordingly, for example, the operating frequency of the cryocooler 16 significantly decreases so as to reach approximately 40 Hz.

The second stage 21 is cooled by the full power operation of the cryocooler 16 similarly to the first stage 20. Since a cooling speed of the second stage 21 is somewhat faster than that of the first stage 20, when the temperature T1 of the first stage 20 reaches the target temperature 100 K, the second stage 21 is cooled so as to reach a temperature (for example, approximately 80 K) which is somewhat lower than the temperature of the first stage 20. However, at this point, the temperature of the second stage 21 is still far lower than the target temperature 15 K of the second stage 21. After the cryocooler 16 is switched from the full power operation into the first stage temperature control, the second stage 21 is gently cooled so as to reach the target temperature 15 K. When a time Tb elapses after starting of the cool-down operation, the temperature T2 of the second stage 21 reaches the target temperature 15 K. In this case, the temperatures of both the first stage 20 and the second stage 21 reach the target cooling temperatures, and the cool-down operation ends.

In the temperature profile shown in FIG. 4, the temperature T2 of the second stage 21 is always lower than the temperature T1 of the first stage 20 by the cool-down operation. However, the temperature profile during the cool-down operation may be changed according to the design of the cryopump (for example, a shape of the cryopanel). In a certain cryopump, in at least a portion of the temperature region during the cool-down operation, the cooling speed of the first stage 20 may be faster than that of the second stage 21. In this case, in at least a portion of the period of the cool-down operation, the temperature T1 of the first stage 20 may be lower than the temperature T2 of the second stage 21.

Figure 5:
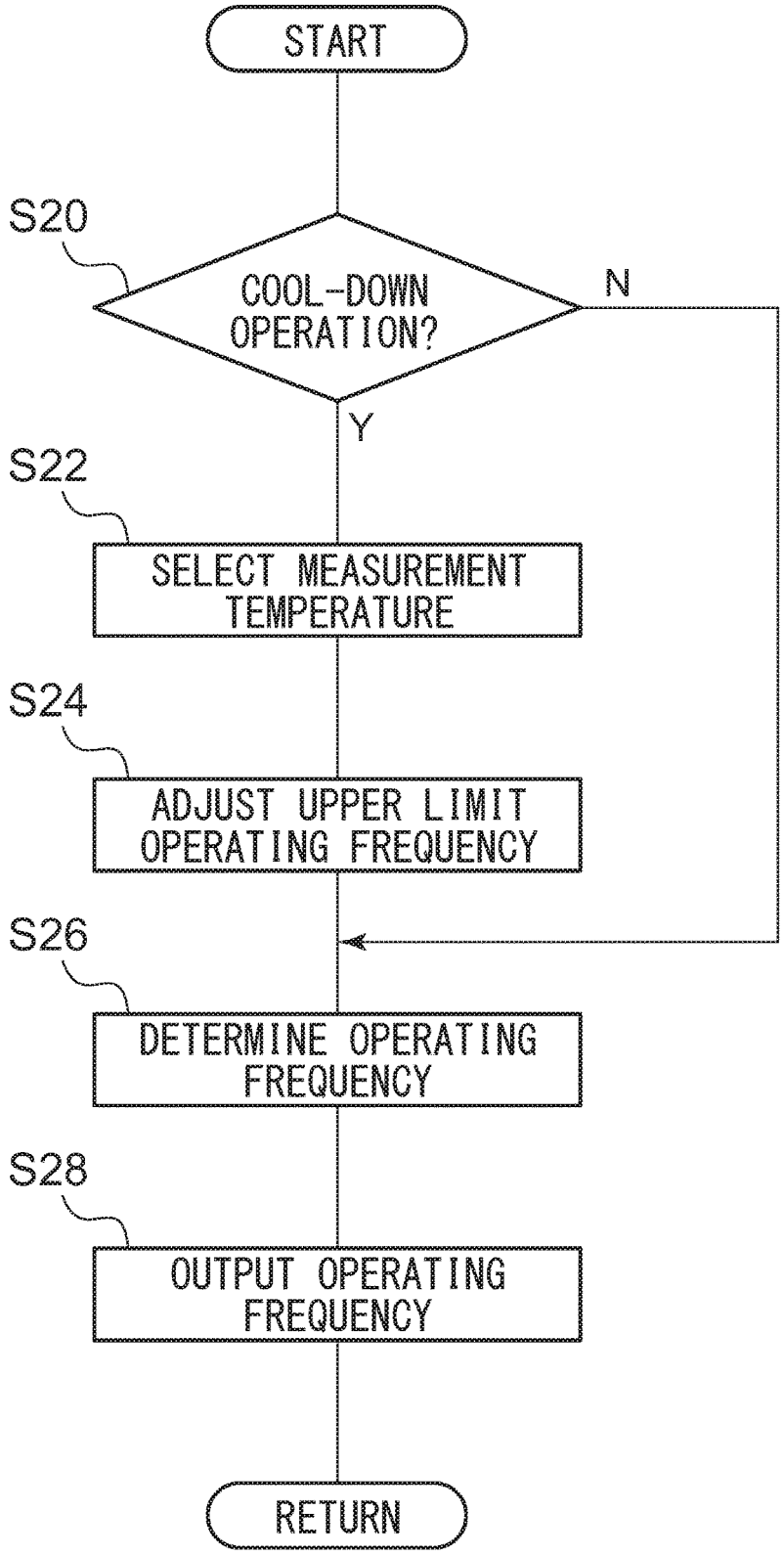
FIG. 5 is a flowchart showing a control method of a cryopump according to an embodiment of the present invention.

FIG. 5 is a flowchart showing a control method of the cryopump 10 according to the embodiment of the present invention. The operation state determination unit 116 determines whether or not a current operation state of the cryopump 10 is the cool-down operation (S20). When the cool-down operation is not performed (for example, the vacuum exhaust operation is performed) (N in S20), the operating frequency determination unit 110 determines the operating frequency of the cryocooler motor 80 within the existing operating frequency range (S26). As described above, for example, the operating frequency determination unit 110 determines the operating frequency using the known method such as the first stage temperature control. The operating frequency determination unit 110 outputs the determined operating frequency to the cryocooler inverter 82 (S28). The cryocooler motor 80 drives the cryocooler 16 at the operating frequency input from the cryocooler inverter 82. Accordingly, when the cool-down operation is not performed, the upper limit operating frequency is not changed.

Meanwhile, during the cool-down operation (Y in S20), the measurement temperature selection unit 114 selects the lower one of the measurement temperature of the first temperature sensor 90 and the measurement temperature of the second temperature sensor 92 (S22). The measurement temperature selection unit 114 compares the measurement temperature of the first temperature sensor 90 and the measurement temperature of the second temperature sensor 92, and determines which one of the two measurement temperatures is the lower measurement temperature. The measurement temperature selection unit 114 provides the selected measurement temperature to the upper limit adjustment unit 112.

The upper limit adjustment unit 112 determines the upper limit operating frequency corresponding to the measurement temperature according to the upper limit frequency profile (S24). The upper limit adjustment unit 112 selects the first upper limit frequency when the measurement temperature is within the first temperature region, and selects the second upper limit frequency when the measurement temperature is within the second temperature region. The upper limit adjustment unit 112 provides the determined upper limit operating frequency to the operating frequency determination unit 110. The upper limit adjustment unit 112 may output the determined upper limit operating frequency to the output unit 108.

The operating frequency determination unit 110 determines the operating frequency of the cryocooler motor 80 within the operating frequency range having the determined upper limit operating frequency (S26). As described above, for example, the operating frequency determination unit 110 determines the operating frequency using the known method such as the first stage temperature control. The operating frequency determination unit 110 compares the operating frequency obtained using the known method and the upper limit operating frequency. When the obtained operating frequency is smaller than the upper limit operating frequency, the operating frequency determination unit 110 outputs the operating frequency to the cryocooler inverter 82 (S28). When the obtained operating frequency exceeds the upper limit operating frequency, the operating frequency determination unit 110 outputs the value of the upper limit operating frequency to the cryocooler inverter 82 (S28). The cryocooler motor 80 drives the cryocooler 16 at the operating frequency input from the cryocooler inverter 82. Accordingly, the processing ends. The cryocooler control unit 102 repeats the processing periodically.

Figure 6:
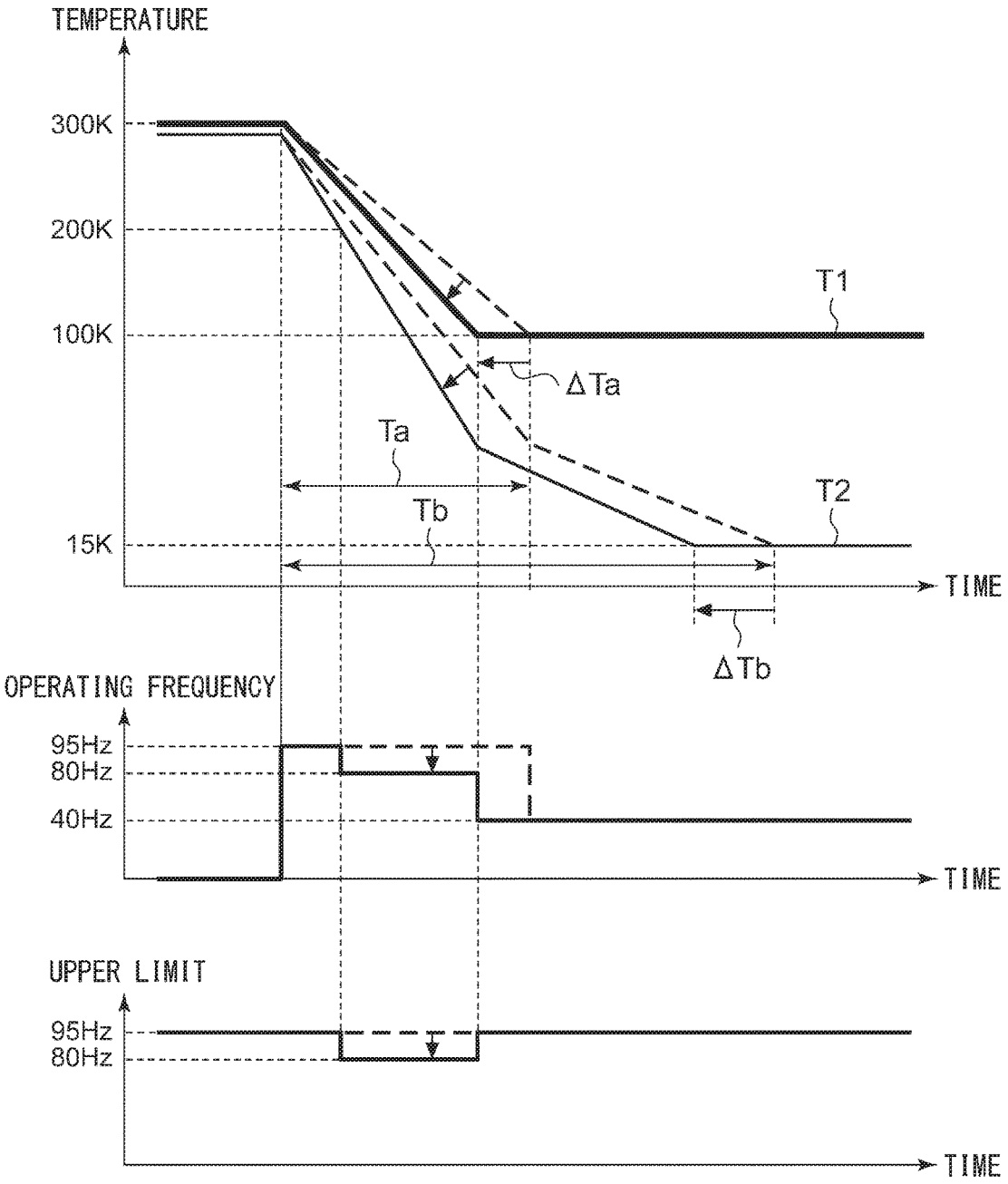
FIG. 6 is a diagram showing an example of a temperature profile in a cool-down operation according to an embodiment of the present invention.

FIG. 6 is a diagram showing an example of the temperature profile in the cool-down operation according to the embodiment of the present invention. Similarly to FIG. 4, in FIG. 6, a vertical axis indicates a temperature, and a horizontal axis indicates a time. For example, the initial values of the temperature T1 of the first stage 20 and the temperature T2 of the second stage 21 when the cool-down operation starts are 300 K, and the target cooling temperatures of the first stage 20 and the second stage 21 are 100 K and 15 K, respectively. For comparison to FIG. 4, in FIG. 6, the temperature profile shown in FIG. 4 is shown by a broken line. In addition, an example of the operating frequency profile of the cryocooler 16 is shown in the intermediate portion of FIG. 6, and an example of the upper limit frequency profile is shown in the lower portion of FIG. 6. Similarly, for comparison to FIG. 4, the operating frequency profile and the upper limit frequency profile shown in FIG. 4 are shown by broken lines.

The upper limit frequency profile has the first upper limit frequency of 95 Hz in the first temperature region from room temperature to 200 K, and has the second upper limit frequency of 80 Hz in the second temperature region from 200 K to 100 K.

The cryocooler 16 is operated with full power until the temperature T1 of the first stage 20 reaches the target temperature 100 K. In this case, the operating frequency of the cryocooler 16 is fixed at the allowable maximum value. In the example shown in FIG. 6, since the second stage 21 is rapidly cooled, the cryocooler 16 is operated at the first upper limit frequency of 95 Hz until the second stage 21 is cooled so as to reach 200 K. When the temperature of the second stage 21 reaches 200 K, the operating frequency of the cryocooler 16 is switched to the second upper limit frequency of 80 Hz. When the temperature of the first stage 20 reaches 100 K, the operation state of the cryopump 10 is transferred from the cool-down operation to the first stage temperature control. In the first stage temperature control, for example, the operating frequency of the cryocooler 16 is significantly decreased so as to reach approximately 40 Hz.

As shown in the drawing, a cooling time ΔTa of the first stage 20 is shortened, and a cooling time ΔTb of the second stage 21 is shortened.

Since the operating frequency of the cryocooler 16 indicates the frequency of the thermal cycle, a decrease in the operating frequency generating a decrease in a refrigeration capacity of the cryocooler 16 can be considered. Accordingly, if the operating frequency during the cool-down operation decreases, the cooling time may be lengthened. The cool-down operation is required so as to be performed at the highest operating frequency as possible. The shortening of the cooling time shown in FIG. 6 is contrary to general knowledge, and this is a surprising result.

According to studies by the inventors, the shortening of the cooling time in the present embodiment being performed by focusing on a density change of the operation gas (helium) in the cool-down operation can be explained. The density of the operating gas increases according to a decrease in the temperature. According to the increase of the density, influence of friction or loss in pressure due to a high-speed operation of the cryocooler 16 increases. Accordingly, an excessive high-speed operation at a low temperature generates a decrease in the cooling efficiency of the cryocooler 16.

According to the present embodiment, it is possible to decrease the upper limit operating frequency of the cryocooler 16 in the latter half of the cool-down operation. By decreasing the friction and the loss in the pressure generated due to the increase of the density of the operation gas, it is possible to maintain the cooling efficiency of the cryocooler 16 or prevent the cooling efficiency from being decreased. Accordingly, it is possible to shorten a required time of the cool-down operation. It is possible to shorten the cooling by approximately 10% according to a certain calculation.

Hereinbefore, embodiments of the present invention are described. The present invention is not limited to the embodiments. That is, a person skilled in the art understands that various designs can be modified, various modifications can be performed, and the modifications are within the ranges of the present invention.

In an embodiment, the upper limit adjustment unit 112 may increase the upper limit operating frequency when the cool-down operation is completed or at an arbitrary timing after the completion of the cool-down operation. For example, the upper limit adjustment unit 112 may restore the decreased upper limit operating frequency at the timing. As shown in FIG. 6, when the operation is transferred from the cool-down operation to the temperature control operation, the upper limit frequency may be switched from the second upper limit frequency to the first upper limit frequency again by the upper limit adjustment unit 112.

It should be understood that the invention is not limited to the above-described embodiment, and may be modified into various forms on the basis of the spirit of the invention. Additionally, the modifications are included in the scope of the invention.

What is claimed is:

1. A cryopump, comprising:

a cryopanel;

a cryocooler which is configured to cool the cryopanel, and includes a cryocooler motor configured to drive the cryocooler and a cryocooler inverter configured to control an operating frequency of the cryocooler motor; and a control unit configured to control the cryocooler to perform a cool-down operation by which a temperature of the cryopanel is decreased from room temperature to a standard operating temperature, wherein the control unit includes, an operating frequency determination unit configured to determine an operating frequency of the cryocooler motor within an operating frequency range having an upper limit operating frequency and outputs the operating frequency to the cryocooler inverter, and an upper limit adjustment unit configured to decrease the upper limit operating frequency based on a decrease in the temperature of the cryopanel during the cool-down operation.

2. The cryopump according to claim 1, further comprising, a storage unit configured to store an upper limit frequency profile which includes a first upper limit frequency with respect to a first temperature region including room temperature, and a second upper limit frequency which includes the standard operating temperature, with respect to a second temperature region lower than the first temperature region, and is smaller than the first upper limit frequency, wherein the upper limit adjustment unit changes the upper limit operating frequency according to the upper limit frequency profile.

3. The cryopump according to claim 2, wherein a boundary temperature between the first temperature region and the second temperature region is less than or equal to 200 K.

4. The cryopump according to claim 2, wherein a decreased amount from the first upper limit frequency to the second upper limit frequency is within 25% of the first upper limit frequency.

5. The cryopump according to claim 1, wherein the cryopump includes a first cryopanel which is cooled to reach a first standard operating temperature, a second cryopanel which is cooled to reach a second standard operating temperature lower than the first standard operating temperature, a first temperature sensor which measures a temperature of the first cryopanel, and a second temperature sensor which measures a temperature of the second cryopanel, wherein the control unit includes a measurement temperature selection unit configured to select the lower temperature of the temperature of the first cryopanel measured by the first temperature sensor and the temperature of the second cryopanel measured by the second temperature sensor, and wherein the upper limit adjustment unit uses a measurement temperature which is selected by the measurement temperature selection unit.

6. A control method of a cryopump, in which the cryopump includes a cryopanel, and a cryocooler which is configured to cool the cryopanel, and includes a cryocooler motor configured to drive the cryocooler and a cryocooler inverter configured to control an operating frequency of the cryocooler motor, comprising:

performing a cool-down operation by which a temperature of the cryopanel is decreased from room temperature to a standard operating temperature;

decreasing an upper limit operating frequency of the cryocooler motor based on a decrease in the temperature of the cryopanel during the cool-down operation;

determining an operating frequency of the cryocooler motor within an operating frequency range having the upper limit operating frequency; and outputting the determined operating frequency to the cryocooler inverter.

7. A cryocooler, comprising:

an expander which includes a cooling stage, an expander motor configured to drive the expander, and an expander inverter configured to control an operating frequency of the expander motor; and a control unit configured to control expander to perform a cool-down operation by which a temperature of the cooling stage is decreased from room temperature to a standard operating temperature, wherein the control unit includes, an operating frequency determination unit configured to determine an operating frequency of the expander motor within an operating frequency range having an upper limit operating frequency and outputs the operating frequency to the expander inverter, and an upper limit adjustment unit configured to decrease the upper limit operating frequency based on a decrease in the temperature of the cooling stage during the cool-down operation.

8. A method of controlling the cryopump according to claim 1, the method comprising:

performing the cool-down operation by which the temperature of the cryopanel is decreased from room temperature to the standard operating temperature;

decreasing the upper limit operating frequency of the cryocooler motor based on the decrease in the temperature of the cryopanel during the cool-down operation;

determining the operating frequency of the cryocooler motor within the operating frequency range having the upper limit operating frequency; and outputting the determined operating frequency to the cryocooler inverter.

* * * * *